US006031434A

United States Patent [19]

Tatomir et al.

[11] Patent Number: 6,031,434

[45] Date of Patent: Feb. 29, 2000

[54] COAXIALLY CONFIGURED OMT-MULTIPLEXER ASSEMBLY

[75] Inventors: Paul J. Tatomir, Laguna Niguel; Daniel J. Hoppe, La Canada; Christ P. Tzelepis, Redondo Beach; Keith N. Loi, Rosemead, all of Calif.

[73] Assignee: Hughes Electronics Corporation, Los Angeles, Calif.

[21] Appl. No.: 09/156,245

[22] Filed: Sep. 18, 1998

[51] Int. Cl.[7] ..... H01P 5/12

[52] U.S. Cl. ..... 333/126; 333/21 A; 333/135

[58] Field of Search ..... 333/21 A, 126, 333/135; 343/786

[56] References Cited

U.S. PATENT DOCUMENTS

| | | | |
|---|---|---|---|
| 3,508,277 | 4/1970 | Ware et al. | 343/786 X |
| 4,819,005 | 4/1989 | Wilkes | 343/786 |

FOREIGN PATENT DOCUMENTS

| | | | |
|---|---|---|---|
| 54-105447 | 8/1979 | Japan | 333/135 |
| 6-140810 | 5/1994 | Japan | 333/135 |

*Primary Examiner*—Justin P. Bettendorf

*Attorney, Agent, or Firm*—Terje Gudmestad; Georgann Grunebach; Michael W. Sales

[57] ABSTRACT

An ortho mode transducer (OMT)/multiplexer assembly having a corrugated junction and a coaxial dual mode waveguide resonator disposed around a central cylindrical waveguide. The corrugated junction diplexes signals, the higher frequencies passing through the central cylindrical waveguide and the lower frequencies passing through the coaxial dual mode resonator. Apertures in the dual mode resonator couple to an exit port and extract a first polarization from the lower frequencies passing through the dual mode resonator. The assembly may include a second aperture in the dual mode resonator for extracting a second polarization in a manner similar to the operation of the first aperture.

20 Claims, 4 Drawing Sheets

COAXIALLY CONFIGURED OMT-MULTIPLEXER ASSEMBLY

BACKGROUND OF THE INVENTION

The present invention relates generally to an ortho mode transducer (OMT)/multiplexer assembly and, more particularly, to an OMT/multiplexer assembly having a corrugated junction.

Typical OMTs are not associated with multiplexing devices or filtering devices. In fact, typical OMTs are limited to a single frequency band. Satellites, however, often have two different frequency bands: an uplink frequency (upper) band and a downlink frequency (lower) band. Until recently, satellites did not routinely require two polarizations for both frequency bands. However, dual polarization transmit/receive subsystems are becoming common in communications and radiometric satellites. With two polarization modes being associated with each band, there is a need for a device which diplexes and ortho mode transduces a plurality of frequency bands.

Conventional signal extraction devices for extracting more than two transmit/receive bands are massive and extract signals in a cumbersome manner using corrugated lowpass filters that are side coupled to square waveguides. There is a need for a device that is compact in a radial dimension and provides improved interband isolation.

Fabrication of conventional OMTs having corrugated lowpass filters often requires costly electroforming. There is a need for a device which can be fabricated by less complex and less costly means such as machining.

Typical OMTs do not have significant filtering capability, and therefore require the employment of relatively expensive components and other units in the system in order to filter downstream in the signal path. There is a need for a device which provides ortho mode transducing and auxiliary filtering so that the specifications of other units in the system can be relaxed.

Thus, there is a need for a single device which can extract both polarizations of multiple transmit and receive bands while providing filtering and isolation between them.

SUMMARY OF THE INVENTION

The aforementioned disadvantages of the prior art devices are overcome using the present invention to multiplex and ortho mode transduce multiple frequency bands. Utilizing a device in accordance with the present invention, multiple frequency bands may be extracted from a cylindrical dual mode waveguide and multiplexed. Coaxial substructures and a waveguide resonator are included in the present invention to enable broadband frequencies covering many waveguide bands and having dual polarization to be separated from a common input port with filtering and isolation between the extracted bands.

One embodiment of the present invention is an ortho mode transducer/multiplexer comprising an outer conductor and a central cylindrical waveguide coaxial with the outer conductor and disposed in the outer conductor. One end of the outer conductor defines a common input port. The outer conductor may include a corrugated portion called a corrugated junction for diplexing signals that enter the common input port. Additionally or alternatively, the central cylindrical waveguide may comprise a corrugated portion. This embodiment also includes a dual mode waveguide resonator disposed coaxially around the central cylindrical waveguide. An exit port is coupled to the dual mode waveguide resonator.

The ortho mode transducer/multiplexer may comprise a second exit port. The exit ports may be disposed at outer ends of rectangular waveguides coupled to the dual mode waveguide resonator. The rectangular waveguides may each comprise an inductive iris or a capacitive iris. The ortho mode transducer/multiplexer may comprise a second corrugated junction. Additionally or alternatively, the ortho mode transducer/multiplexer may comprise a second dual mode waveguide resonator coupled to the dual mode waveguide resonator. The ortho mode transducer/multiplexer may comprise a polarizer coupled to the outer conductor, a polarizer coupled to the central cylindrical waveguide, or both types of polarizers.

Another embodiment of the present invention comprises an outer conductor and a central cylindrical waveguide coaxial with the outer conductor and disposed within the outer conductor. One end of the outer conductor defines a common input port. The outer conductor may include a corrugated portion called a corrugated junction for diplexing signals that enter the common input port. Additionally or alternatively, the central cylindrical waveguide may include a corrugated portion. This embodiment further includes a dual mode waveguide resonator disposed coaxially around the central cylindrical waveguide and a rectangular waveguide connected to the dual mode waveguide resonator. The rectangular waveguide comprises a first rectangular resonator and an exit port, both of which are coupled to the dual mode waveguide resonator.

A further aspect of the present invention is a method for multiplexing and ortho mode transducing an electromagnetic signal having a dual polarized low frequency band and a high frequency band. The method comprises the steps of: (1) multiplexing the signal with a corrugated junction and (2) ortho mode transducing the low frequency band by propagating the low frequency band through a resonator coaxial with the central cylindrical waveguide and through a rectangular waveguide coupled to the resonator. The upper band may also be ortho mode transduced if desired.

DETAILED DESCRIPTION OF THE INVENTION

Figure 1:
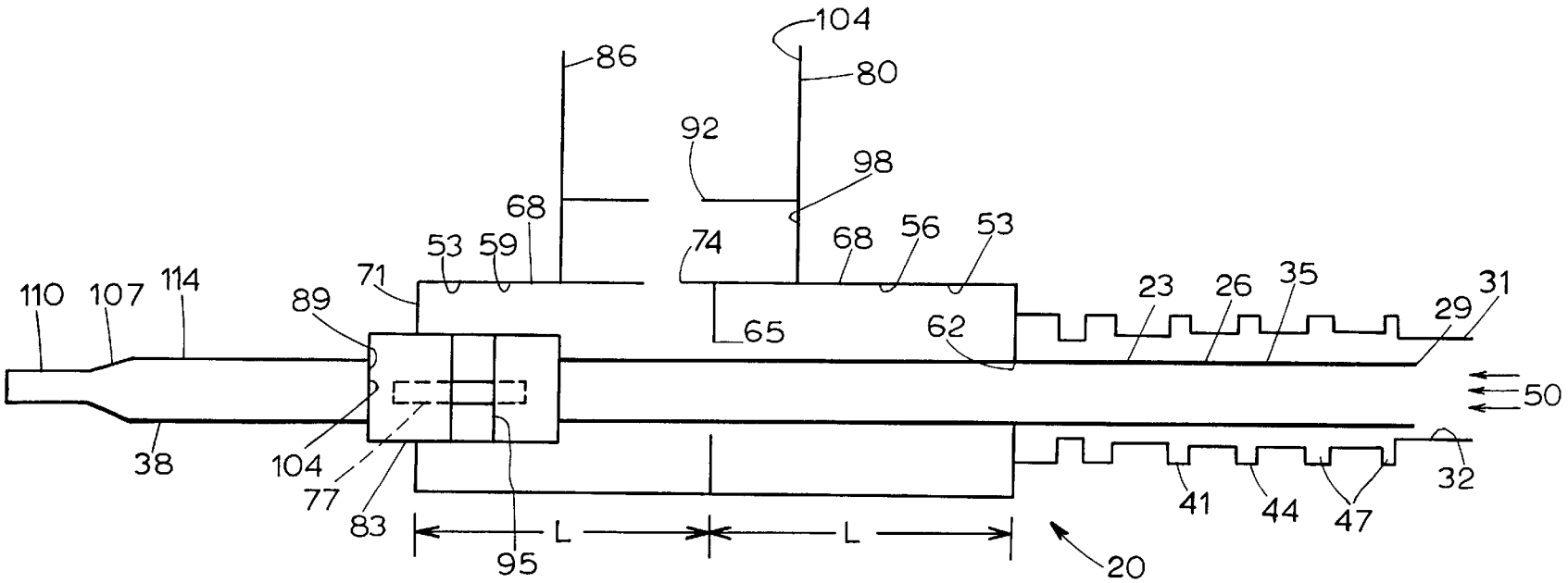
FIG. 1 is a schematic cross-section of a coaxial configured ortho mode transducer/multiplexer assembly in accordance with the present invention.
Figure 2:
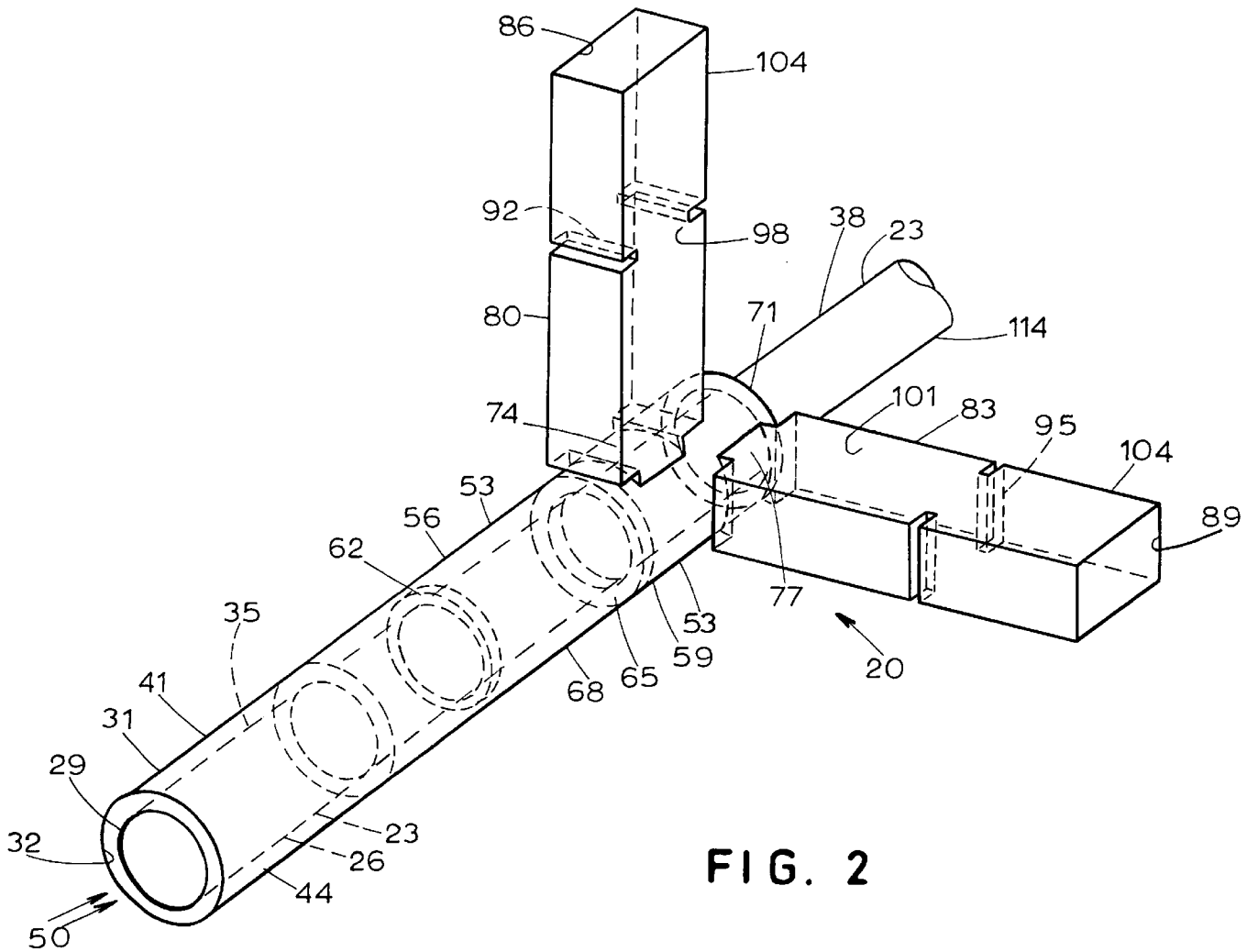
FIG. 2 is a perspective of the embodiment of FIG. 1 with portions shown schematically and with the corrugated junction shown without corrugations for ease of illustration.

Referring initially to FIGS. 1 and 2, a coaxially configured ortho mode transducer (OMT)/multiplexer assembly, designated generally at 20, comprises a central cylindrical waveguide 23 having an outer wall 26. The central cylindrical waveguide 23 has a first end 29 or coaxial waveguide junction, a first end portion 35, and a second end portion 38. An outer conductor 31 having a common cylindrical input port 32 at one end is disposed is coaxial with the central cylindrical waveguide 23 outside of the central cylindrical waveguide 23. Coaxial substructures and a waveguide resonator, described in detail below, are included in the assembly 20 to enable broadband frequencies covering many waveguide bands and having dual polarization to be separated from the common input port 32 with filtering and isolation between the extracted bands.

Figure 3:
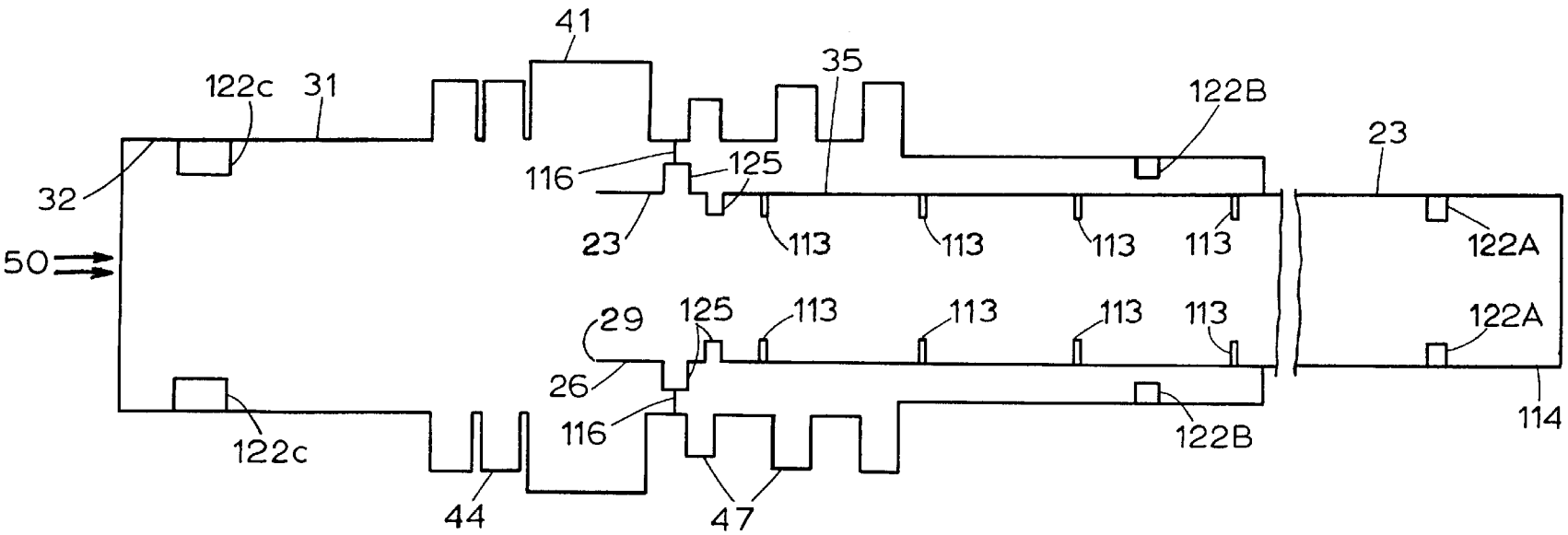
FIG. 3 is a cross-section of a corrugated junction and a central cylindrical waveguide each having apertures on respective interior surfaces.

The outer conductor 31 may include a corrugated junction 41. The corrugated junction 41 comprises an outer wall 44 having corrugations 47 which are coaxial with the longitudinal axis of the outer conductor 31. The corrugations 47 may all be circular in a cross-section taken transverse to the longitudinal axis of the central cylindrical waveguide 23. The corrugated junction 41 acts as a bandpass filter, diplexing a band or bands 50 that enter the input port 32, as discussed in more detail below. As seen in FIG. 3, the outer conductor 31 may define a space that extends from the common input port 32 to the first end 29 of the central cylindrical waveguide 23. The space permits propagation of all frequencies that entered the common input port 32.

At least one dual mode coaxial waveguide resonator 53 (also called a cavity or filter) is disposed coaxially around the central cylindrical waveguide 23. First and second dual mode coaxial waveguide resonators 56, 59 are shown in FIGS. 1 and 2. The first coaxial waveguide resonator 56 is defined between a first aperture 62, a second aperture 65, an outer wall 68, and the central cylindrical waveguide 23. The first dual mode coaxial waveguide resonator 56 is adjacent the coaxial corrugated junction 41. The second dual mode coaxial waveguide resonator 59 is also disposed coaxially around the central cylindrical waveguide 23 but is defined between the second aperture 65 and an end wall 71.

Each coaxial waveguide resonator 53 has a longitudinal length (L). The length (L) of the first coaxial waveguide resonator 56 may be different from the length (L) of the second coaxial waveguide resonator 59. Additional coaxial waveguide resonators 53 may also have different lengths (L).

The first and second apertures 62, 65 may be small openings in the resonator outer wall 68. Typically, a change in diameter in the central cylindrical waveguide 23 or in the resonator outer wall 68 occurs near each aperture 62, 65. Consequently, either the central cylindrical waveguide 23 or resonator outer wall 68 typically has a different diameter between the apertures 62, 65 and between the apertures 65, 71 than on the other side of those apertures. The location of an aperture is typically a boundary of a resonator, which is the case for the first and second apertures 62, 65 defining the first dual mode coaxial waveguide resonator 56. The shape of the apertures 62, 65 may be any suitable shape including rectangular. The first and second apertures 62, 65 in FIGS. 1 and 2 are circularly symmetrical apertures.

The number of dual mode coaxial waveguide resonators 53 may be varied if desired in order to provide different degrees of filtering or achieve a particular frequency response. Both polarizations of a signal with two polarizations pass through the first and second apertures 62, 65.

Coupled to the second dual mode coaxial waveguide resonator 59 are a pair of inductive irises 74, 77 (also called coupling apertures) which magnetically couple each mode of the second dual mode waveguide resonator 59 with a respective rectangular waveguide 80, 83.

The rectangular waveguides 80, 83 terminate at exit ports 86, 89, respectively, and have rectangular waveguide inductive irises 92, 95, respectively, disposed between the exit ports 86, 89 and the inductive irises 74, 77 that couple the rectangular waveguides 80, 83 to the second coaxial waveguide resonator 59. Capacitive irises may be used instead of the inductive irises 92, 95. A pair of third resonators, which are rectangular resonators 98, 101, are disposed in the respective rectangular waveguides 80, 83 and are defined between the respective inductive irises 74, 77 and the respective rectangular waveguide inductive irises 92, 95. Each rectangular waveguide 80, 83 has an outer portion, called a leader 104, that extends from the respective rectangular waveguide inductive iris 92, 95 to the respective exit port 86, 89.

In the embodiment of FIGS. 1 and 2, after a dual polarized signal passes through the dual mode coaxial resonators 56, 59, each polarization passes through a respective one of the inductive irises 74, 77 and into the respective rectangular resonator 98, 101 in the respective rectangular waveguide 80, 83. Orthogonal modes or polarizations of the extracted low frequency band are coupled out of the exit ports 86, 89.

The second end portion 38 of the central cylindrical waveguide 23 is an output for the upper frequency band or bands. The second end portion 38 may be attached to a cylindrical-to-rectangular waveguide transition 107 or a standard OMT (not shown) or another corrugated diplexer junction (not shown).

The function of the assembly 20 is described in detail below using an example input signal comprising a dual polarization lower band signal and a dual polarization upper band signal. However, other combinations of signals can be multiplexed and ortho mode transduced by the present invention. For example, any multifrequency band having dual ortho polarization in at least one of the bands is suitable. Also, although the example below illustrates the use of the assembly 20 for separating signals, the assembly is electrically reciprocal.

The upper and lower frequency signals enter the assembly 20 together through the common cylindrical input port 32 in the form of the $TE_{11}$ cylindrical mode. Proceeding from right to left in FIG. 1, the signals are separated by frequency in the corrugated junction 41.

Both polarizations or modes of the higher frequency band pass through the central cylindrical waveguide 23 longitudinally, the diameter of the common cylindrical input port 32 being larger than the central cylindrical waveguide 23. The central cylindrical waveguide 23 has a circular $TE_{11}$ configuration that extends to the cylindrical-to-rectangular transition 107 at the far left of FIG. 1 or to another corrugated junction (not shown). The transition 107 can be replaced by a standard OMT to extract both polarizations of the higher frequency band if desired. In the case of embodiments having the transition 107, as depicted in FIG. 1, one polarization passes through a rectangular guide 110 coupled to the transition such that a predetermined mode is transformed to a rectangular $TE_{10}$ configuration. The other polarization is reflected by the transition section 107 toward the input port 32.

The corrugated junction 41 also acts as a bandpass filter. At the corrugated junction 41, lower frequencies travel in the coaxial $H_{11}$ modes of both polarizations along the region defined between the outer wall 44 of the corrugated junction 41 and the outer wall 26 of the central cylindrical waveguide 23. The corrugations 47 provide for optimum match at specified frequencies. The geometry and dimensions of the corrugations 47 can be varied to determine which frequencies are cutoff. Among the variables affecting the frequency response of the corrugated junction 41 are the thickness of the corrugations 47 in the longitudinal direction, the inner and outer diameter of the corrugations 47, and the diameter of the central cylindrical waveguide 23 that extends through the corrugated junction 41. Suitable materials for corrugated junctions 41 are well known in the art and include any highly conductive metal or any material having a metallized interior surface.

As seen in FIG. 3, the central cylindrical waveguide 23 may comprise apertures 113 disposed on an interior surface. The central cylindrical waveguide apertures 113 provide filtering for signals passing through the central cylindrical waveguide 23, such as high frequency bands rejected by the corrugated junction 41.

Also shown in FIG. 3 are apertures 116 in the corrugated junction 41 which provide matching for signals passing through the corrugated junction 41. The apertures 116 are defined by corrugations 125 which may be placed in or outside of the central cylindrical waveguide 23 to provide impedance matching similar to the impedance matching provided by the corrugations 47 described above. The assembly 20 may comprise the corrugations 125 (in or outside of the central cylindrical waveguide 23) in addition to the corrugations 47 or as an alternative to the corrugations 47. The assembly 20 may comprise the apertures 113 or the apertures 116, both the apertures 113 and 116 or neither of those apertures.

When broadband frequencies pass through the corrugated junction 41, the lower frequencies propagate to the dual mode coaxial waveguide resonators 53. The dual mode coaxial waveguide resonators 53 resonate at a lower frequency band than the central cylindrical waveguide 23. After both polarizations pass through the coaxial resonators 53, the lower frequencies enter the respective rectangular resonators 98, 101 in the respective rectangular waveguides 80, 83 where the lower frequencies undergo continued bandpass filtering for each polarization.

Each rectangular waveguide 80, 83 extracts a particular polarization or mode of a low frequency band that had been diplexed from the band or bands that passed through the corrugated junction 41. In the embodiment of FIGS. 1 and 2, the horizontal polarization (in the plane of the drawing sheet of FIG. 1) is extracted from the first rectangular waveguide 80 and the vertical polarization (perpendicular to the drawing sheet of FIG. 1) from the second rectangular waveguide 83. The location of the first and second inductive irises 74, 77 is generally a position at which there are magnetic field maxima in the coaxial waveguide resonator 53 in which the first and second inductive irises 74, 77 are located. The location of magnetic field maxima in the coaxial waveguide resonator 53 can be readily determined by people of ordinary skill in the art.

In the embodiment of FIGS. 1 and 2, each polarization of a dual polarized low frequency band will pass through three resonators. Such an arrangement is called a three section filter, a third order filter, or a three cavity resonator. Some filtering occurs in all of the resonators. The resonators may be intercoupled with apertures (as shown), loops (not shown) or probes (not shown).

Filters of higher order can be realized by adding apertures to form additional resonators. If desired, any number of rectangular resonators can be added to each rectangular waveguide 80, 83 for additional bandpass filtering. Additional resonators may be added, for example, by putting more apertures in the leader 104 to define extra resonators therein. Apertures coaxial with and disposed around the central cylindrical waveguide 23 can be added to increase the number of coaxial waveguide resonators 53.

If desired to increase the number of resonators, one or more resonators may be added to the rectangular waveguides 80, 83 and one or more dual mode coaxial waveguide resonators 53 may be added. For example, by adding a rectangular resonator (to each rectangular waveguide 80, 83) and a dual mode coaxial waveguide resonator 53 to the embodiment of FIGS. 1 and 2, a device having fifth order filtering capability can be formed.

Devices having fewer resonators than shown in FIGS. 1 and 2 are also contemplated. For example, an embodiment having the first aperture 62 but not the second aperture 65 would have only a single dual mode coaxial resonator 53 rather than two such resonators. Such an embodiment would have second order filtering capability, assuming that it had one rectangular resonator in each of the rectangular waveguides 80, 83.

Similarly, in an embodiment similar to the embodiment of FIG. 1 but without the rectangular waveguide inductive irises 92, 95 in the rectangular waveguides 80, 83, there would be two dual mode coaxial waveguide resonators 53 but no rectangular resonators. Such an embodiment would thus have second order filtering capability.

Although shown in FIG. 1 to be located in the second dual mode coaxial waveguide resonator 59, the first and second inductive apertures 74, 77 coupling the dual mode coaxial waveguide resonators 53 to the rectangular waveguides 80, 83 do not have to be in the second dual mode coaxial waveguide resonator 59. Instead, the rectangular waveguides 80, 83 may be attached to the first dual mode coaxial waveguide resonator 56 or, in embodiments having more than two dual mode coaxial waveguide resonators 53, to another dual mode waveguide resonator 53.

Additionally, although shown in FIGS. 1 and 2 as being attached to the same coaxial waveguide resonator 53, the first and second rectangular waveguides 80, 83 need not be attached to the same resonator 53 as one another. Note that the rectangular waveguides 80, 83 are each electromagnetically coupled to all of the coaxial waveguide resonators 53 even though each rectangular waveguide 80, 83 is physically attached to only a single coaxial waveguide resonator 53. If attached to different coaxial waveguide resonators 53, the first and second rectangular waveguides 80, 83 may contain a different number of rectangular resonators than one another. For example, if the first rectangular waveguide 80 is attached to the first coaxial waveguide resonator 56, and the second rectangular waveguide 83 is attached to the second coaxial waveguide resonator 59, in order to have third order filtering of both polarizations of a dual polarized signal, the first rectangular waveguide 80 will have two rectangular resonators and the second rectangular waveguide 83 will have only one rectangular resonator.

A third rectangular waveguide (not shown) may be coupled to the dual mode coaxial waveguide resonators 53 to extract a combination of the respective polarities extracted by the first and second rectangular waveguides 80, 83. The third rectangular waveguide may be positioned, with respect to the longitudinal axis of the central cylindrical waveguide, at an angle different from the angles of the first and second rectangular waveguides 80, 83.

If only one exit port is coupled to the dual mode coaxial waveguide resonators 53, then only one polarization is extracted. If any other polarizations are present in the input signal those polarizations are reflected out of the common cylindrical input port 32.

In an alternative embodiment, both orthogonal modes of a dual mode band may exit a dual mode coaxial waveguide resonator 53 from a single aperture rather than the first and second inductive irises 74, 77. In such a case, the aperture would extend 90 degrees around a longitudinal axis of the dual mode coaxial waveguide resonator 53 having the aperture so that the orthogonal modes could exit the aperture at locations that are 90 degrees from one another with respect to the longitudinal axis.

Two different coaxial mode patterns (e.g., horizontal polarization and vertical polarization) can be extracted based on the coaxial waveguide resonator 53 geometries. Further, the modes can be any number of degrees apart. The modes shown in FIG. 1 are 90 degrees apart. If 90 degrees apart, the signals may have the same mode pattern or a different mode pattern. If not 90 degrees apart, then the signals have different mode patterns than what is pictured but similar mode patterns to each other. In other words, orthogonal, degenerate modes for each polarization are typically extracted or coupled to one or two rectangular exit ports. The first and second inductive irises 74, 77 or any other apertures used in place thereof can be positioned other than 90 degrees apart as can the exit ports 86, 89. Also, although the exit ports 86, 89 of the embodiment of FIGS. 1 and 2 are coupled to the $H_{112}$ mode, the exit ports 86, 89 can instead be coupled to other modes such as $H_{111}$ or $H_{113}$ depending on the frequency bands of operation.

Among the variables that determine the frequency response of the dual mode coaxial waveguide resonators 53 are the outer diameter, inner diameter, and the length (L) of the resonators 53 in a longitudinal direction. Suitable materials for the dual mode coaxial waveguide resonators 53 include any highly conductive metal or any material having a metallized interior surface.

The diplexing operation of the device is summarized as follows. Lower bands are prohibited from passing through the relatively small circular center of the central cylindrical waveguide 23 by the cutoff nature of the central cylindrical waveguide 23. Some of those lower bands are also rejected by the dual mode coaxial waveguide resonators 53 which act as bandpass filters, the rejected lower bands being reflected out of the common port 32. A wide range of frequencies may be fractionally distilled by this method.

Multiple waveguide frequency bands can be multiplexed in a similar fashion by connecting the second end portion 38 of the central cylindrical waveguide 23 of FIGS. 1 and 2 to a second coaxial corrugated junction (not shown) having a smaller diameter than the first corrugated junction 41. The second corrugated junction separates out a third (and higher) band of frequencies. The second corrugated junction is not positioned after a cylindrical-to-rectangular transition such as the cylindrical-to-rectangular transition 107 but rather is connected directly to the second end portion 38 of the central cylindrical waveguide 23 which is smaller in diameter than earlier sections of the central cylindrical waveguide 23. The second coaxial corrugated junction separates the lowest band (which is a band that is higher in frequency than the band previously extracted by the dual mode coaxial waveguide resonators 53) from the bands that passed through the central cylindrical waveguide 23.

Figure 4:
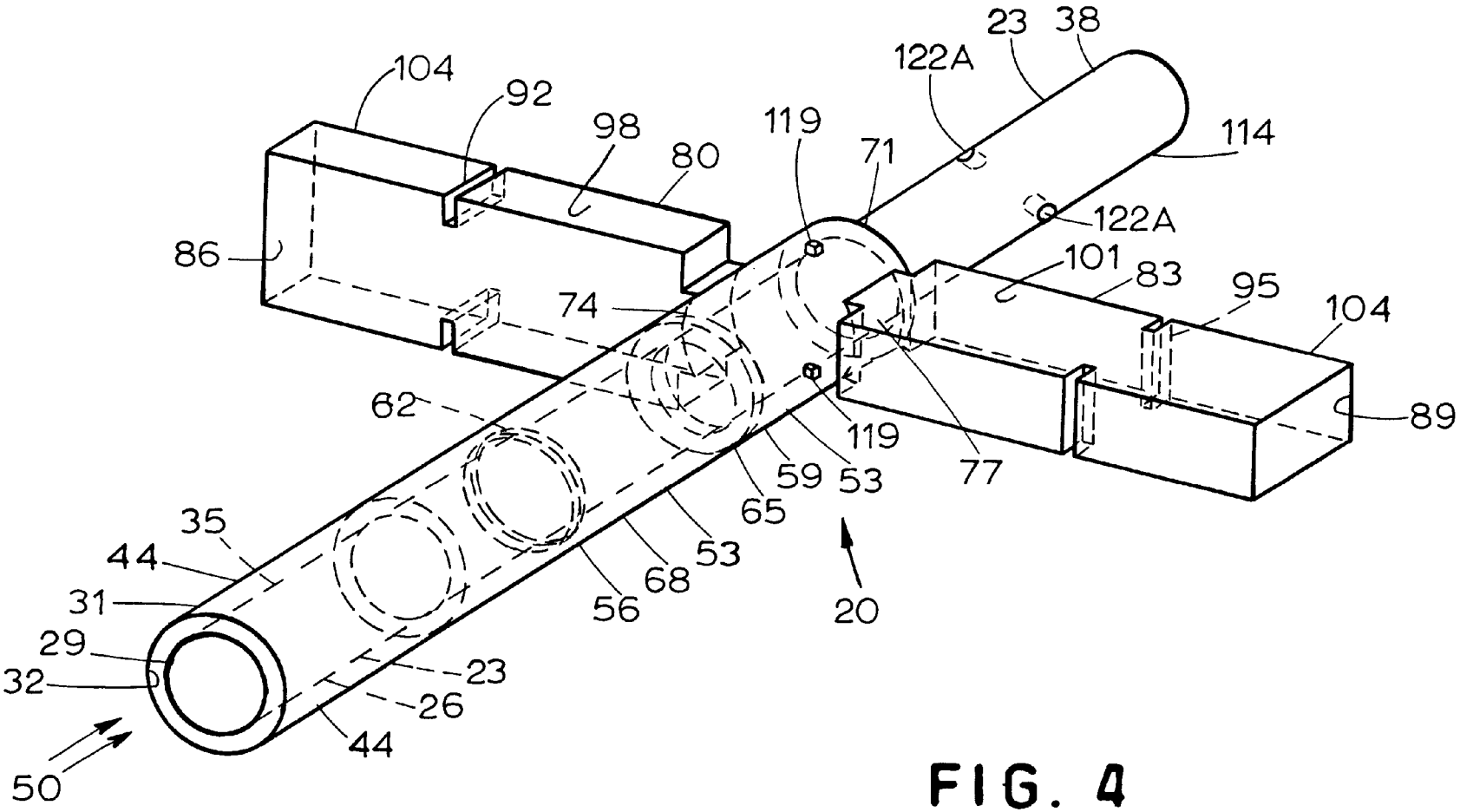
FIG. 4 is a perspective of an alternative embodiment of the present invention similar to the embodiment of FIG. 1 and having rectangular waveguides that are parallel to one another, the embodiment being depicted with portions shown schematically.

In an alternative embodiment, seen in FIG. 4, the rectangular waveguides 80, 83 extend along the same longitudinal ax is as one another rather than perpendicular to one another. Additionally, the first rectangular waveguide 80 is rotated 900 on its longitudinal axis. For extracting the $H_{112}$ mode, the first inductive iris 74 is positioned one-half the length (L) of the second coaxial waveguide resonator 59 from the second aperture 65 so that the first inductive iris 74 is centered on a magnetic field maxima. Also, the second inductive iris 77 is positioned one-quarter L from the second aperture 65 so that the second inductive iris 77 is centered on a magnetic field maxima. Generally, the first and second inductive irises 74, 77 or any other aperture used in their place are positioned where there are magnetic field maxima in the coaxial waveguide resonator 53 having the inductive irises 74, 77 or other apertures. Locations of field maxima may vary among different modes, however, such locations can be readily determined by people of ordinary skill in the art. For coupling the $H_{112}$ mode, an inductive iris is employed at the junction of each rectangular waveguide 80, 83 with the coaxial waveguide resonators 53. Instead of inductive irises, probes may be used to couple electric fields.

In the embodiment of FIG. 4, tuning buttons 119 may be disposed on the outer wall of the second resonator for fine tuning the frequency response.

The embodiment of FIG. 4 is depicted without corrugations in either the central cylindrical waveguide 23 or the outer conductor 31. Corrugations such as the corrugations 47 or the corrugations 125 may be incorporated into the embodiment of FIG. 4 so that FIG. 4 has a corrugated junction.

Other features may be integrated into the assembly 20 for modifying signals flowing therethrough. For example, one or more of polarizers 122A–122C (shown in FIG. 3 schematically) can be integrated into the assembly 20 for converting linear signals to circularly polarized signals and vice versa. The polarizers 122A may be placed in the central cylindrical waveguide 23 between the last internal aperture 113 and a cylindrical output 114 that is part of the central cylindrical waveguide 23. The polarizers 122A generally operate on high frequencies. The output from the output 114 is either (a) two linear modes (e.g., a vertical and a horizontal mode) or (b) right and left hand circularly polarized modes. The polarizers 122A switch the form of polarization of the output from (a) to (b) or from (b) to (a) depending upon the input signal 50.

The polarizers 122B may be placed in the outer conductor 31 between the last corrugation 47 of the corrugated junction 41 and the first aperture 62. The polarizers 122B operate on low frequencies.

Additionally or alternatively, the wideband polarizers 122C may be placed in the outer conductor 31 between the common cylindrical input port 32 and the first corrugation 47 of the corrugated junction 41 to operate on all frequencies.

Either a wideband polarizer covering all frequencies (such as the polarizer 122C) may be put in the coaxial waveguide 31 upstream of the first corrugation 47 or individual polarizers (such as the polarizers 122A and 122B) may be inserted downstream of the corrugated junction 41 to polarize the high and low frequency bands individually.

The assembly 20 is an electrically reciprocal device and can be used to combine two or more bands rather than diplex and extract bands. To combine a first and second polarity of the same frequency band, each polarity must enter one of the respective exit ports 86, 89 and pass through the respective rectangular waveguides 80, 83. If the signals are of a frequency that (a) cannot pass through the central cylindrical waveguide 23 (which acts as a filter) and (b) can pass through the corrugated junction 41, then the combined signals pass out of the common cylindrical input port 32. Otherwise, the signals are reflected at ports 86 and 89. Multiple assemblies 20, coaxially aligned and having different frequency responses, may be used to combine more than two frequency bands in a manner similar to that described above for a single assembly.

The above detailed description is provided for clearness of understanding only and no unnecessary limitations therefrom should be read into the following claims.

We claim:

1. An ortho mode transducer/multiplexer comprising:

an outer conductor defining a common input port at one end;

a central cylindrical waveguide coaxial with the outer conductor and disposed within the outer conductor;

a first corrugated junction located on one of the outer conductor and the central cylindrical waveguide, the corrugated junction comprising a plurality of symmetrical corrugations circumferentially disposed coaxial to the outer conductor;

at least one dual mode waveguide resonator disposed around the central cylindrical waveguide, the at least one dual mode waveguide resonator being coaxial with the central cylindrical waveguide;

a rectangular waveguide coupled to the at least one dual mode coaxial waveguide resonator;

a resonator coupled to the rectangular waveguide; and an exit port coupled to the dual mode waveguide resonator.

2. The ortho mode transducer/multiplexer of claim 1 wherein the corrugations are circular in transverse cross-section.

3. The ortho mode transducer/multiplexer of claim 1 wherein circular apertures are disposed on one of an interior surface of the first corrugated junction and an exterior surface of the central cylindrical waveguide.

4. The ortho mode transducer/multiplexer of claim 1 and further comprising a second exit port.

5. The ortho mode transducer/multiplexer of claim 4 wherein the first and second exit ports are disposed at outer ends of respective first and second rectangular waveguides coupled to the dual mode waveguide resonator.

6. The ortho mode transducer/multiplexer of claim 5 wherein the first and second rectangular waveguides each comprise a rectangular resonator.

7. The ortho mode transducer/multiplexer of claim 6 wherein the first and second rectangular waveguides each comprise an iris selected from the group consisting of inductive irises and capacitive irises.

8. The ortho mode transducer/multiplexer of claim 5 wherein the second rectangular waveguide has a longitudinal axis perpendicular to a longitudinal axis of the first rectangular waveguide.

9. The ortho mode transducer/multiplexer of claim 1 wherein the central cylindrical waveguide comprises corrugations on an interior surface.

10. The ortho mode transducer/multiplexer of claim 1 and comprising:

a second corrugated junction comprising a plurality of corrugations disposed coaxially to the central cylindrical waveguide; and the second corrugated junction being disposed adjacent a side of the dual mode waveguide resonator distal from the first corrugated junction.

11. The ortho mode transducer/multiplexer of claim 1 and comprising an additional dual mode waveguide resonator coupled to the dual mode waveguide resonator.

12. The ortho mode transducer/multiplexer of claim 1 and comprising a polarizer coupled to one of the outer conductor and the central cylindrical waveguide.

13. An ortho mode transducer/multiplexer comprising:

an outer conductor defining a common input port at one end;

a central cylindrical waveguide coaxial with the outer conductor and disposed within the outer conductor;

a first corrugated junction located on one of the outer conductor and the central cylindrical waveguide, the corrugated junction comprising a plurality of corrugations disposed coaxial to the outer conductor;

a dual mode waveguide resonator disposed around the central cylindrical waveguide, the dual mode waveguide resonator being coaxial with the central cylindrical waveguide; and a first rectangular waveguide connected to the dual mode waveguide resonator, the first rectangular waveguide comprising a first rectangular resonator coupled to the dual mode waveguide resonator and a first exit port coupled to the dual mode waveguide resonator.

14. The ortho mode transducer/multiplexer of claim 13 and comprising an additional dual mode waveguide resonator coupled to the dual mode waveguide resonator.

15. The ortho mode transducer/multiplexer of claim 13 wherein the first rectangular waveguide comprises an iris selected from the group consisting of inductive irises and capacitive irises.

16. The ortho mode transducer/multiplexer of claim 13 and comprising a second rectangular waveguide attached to the dual mode waveguide resonator.

17. The ortho mode transducer/multiplexer of claim 16 wherein the second rectangular waveguide has a longitudinal axis perpendicular to a longitudinal axis of the first rectangular waveguide.

18. The ortho mode transducer/multiplexer of claim 16 wherein the second rectangular waveguide has a longitudinal axis parallel to a longitudinal axis of the first rectangular waveguide.

19. The ortho mode transducer/multiplexer of claim 13 and comprising a polarizer coupled to one of the central cylindrical waveguide and the outer conductor.

20. A method for multiplexing and ortho mode transducing an electromagnetic signal having a dual polarized low frequency band and a high frequency band, the method comprising the steps of:

multiplexing the signal with a corrugated junction; and ortho mode transducing the low frequency band by propagating the low frequency band through a resonator coaxial with the corrugated junction and through a rectangular waveguide resonator coupled to the ortho mode transducer.

* * * * *